US007025397B2

(12) United States Patent
Simone

(10) Patent No.: US 7,025,397 B2
(45) Date of Patent: Apr. 11, 2006

(54) ROOF SHINGLE DISPOSAL SCOOP

(76) Inventor: John J. Simone, 1349 S. Hampton Rd., Philadelphia, PA (US) 19116

( * ) Notice: Subject to any disclaimer, the term of this patent is extended or adjusted under 35 U.S.C. 154(b) by 0 days.

(21) Appl. No.: 10/735,997

(22) Filed: Dec. 15, 2003

(65) Prior Publication Data

US 2005/0126050 A1 Jun. 16, 2005

(51) Int. Cl.
*A01B 1/02* (2006.01)
*A47F 13/08* (2006.01)

(52) U.S. Cl. ..... 294/55; D08/10

(58) Field of Classification Search ..... 37/285, 37/264, 265, 379, 380, 411, 443, 444; 172/371, 172/377, 381; 294/55; D08/10
See application file for complete search history.

(56) References Cited

U.S. PATENT DOCUMENTS

| | | | | |
|---|---|---|---|---|
| 63,139 | A | | 3/1867 | Clark |
| 256,150 | A | | 4/1882 | Mattoon |
| 280,990 | A | | 7/1883 | Wynkoop |
| 633,787 | A | | 9/1899 | Brown |
| 636,735 | A | | 11/1899 | Davenport |
| 741,195 | A | | 10/1903 | Voelker |
| 2,756,698 | A | * | 7/1956 | Eichin et al. ..... 425/286 |
| 2,864,117 | A | | 12/1958 | Williams |
| 3,026,138 | A | | 3/1962 | Benjamin et al. |
| 4,245,411 | A | | 1/1981 | McMath |
| 4,631,774 | A | | 12/1986 | Kania |
| 4,850,509 | A | * | 7/1989 | Hollenberg ..... 206/205 |
| D322,543 | S | | 12/1991 | Jenkins et al. |
| 5,137,316 | A | * | 8/1992 | Foos ..... 294/55 |
| 5,365,632 | A | | 11/1994 | Kirchnavy |
| 5,695,011 | A | | 12/1997 | Daniels |
| D392,522 | S | | 3/1998 | Kenyon |
| 5,878,461 | A | | 3/1999 | Killian |

* cited by examiner

*Primary Examiner*—Christopher J. Novosad
(74) *Attorney, Agent, or Firm*—Kenneth P. Glynn

(57) ABSTRACT

The present invention relates to a scoop for use on non-horizontal work surfaces, such as land slopes, roofs and the like. The scoop includes a first base panel and a second base panel, each of the first and second base panels having a front edge, a back edge and two side edges. The first base panel and the second base panel are connected to one another along a side edge of each to establish a seam wherein a first angle measured perpendicular to that seam and is formed by the first and second panels, at about 120 degrees to about 170 degrees. The scoop also includes a first wall panel and a second wall panel, the first wall panel being connected to the first base panel on a side opposite the seam and at an angle, referred to herein as the second angle, being about 120 degrees to about 170 degrees. The second wall panel is connected to the second base panel on a side opposite the seam and at an angle, referred to herein as a third angle, of about 120 degrees to about 170 degrees. There is also a back panel, which is connected to the back edges of the first and second base panels. A handle is also included.

15 Claims, 3 Drawing Sheets

ROOF SHINGLE DISPOSAL SCOOP

BACKGROUND OF THE INVENTION

1. Field of the Invention

The present invention relates to a scoop that has been developed for use on sloped surfaces, such as rooftops, hillsides, material piles and other non-horizontal surfaces wherein a scoop or shovel could be used to deliver or remove material. In one particularly difficult trade, roofing, roof repairs and roof removal, the use of a present invention tool would provide enhanced speed and efficiency, increase productivity of workers, and even reduce backache. Thus, the present invention scoop is uniquely tailed fro depositing or removing materials and debris from sloped surfaces.

2. Information Disclosure Statement

The following patents illustrate various types of scoops and shovels:

U.S. Pat. No. 5,878,461 describes a device for collecting, compressing and discharging loose material, the device being formed from a body of flexible material having a self-sustaining, scoop-shape. The body has a flat bottom, lateral sides, and an open top. The bottom merges with the lateral sides at one of the ends of the body to form a flat edge thereat, and at its other end, the body has an end wall extending upright from the bottom. The lateral sides have upper edges extending from the flat edge upwardly to an upper edge of the end wall thereby defining an open, interior cavity adapted for receiving loose material therein. The lateral sides and bottom are joined to the end wall by forming stabilizing comers which provide the self-sustaining shape of the body while the flexible material of the body allows the lateral sides to be overlapped on one another to compress and confine loose material in the cavity. When the lateral sides are overlapped on one another, an opening is formed from which the compressed, loose material can be discharged into a receptacle.

U.S. Pat. No. 5,695,011 describes a multipurpose work-saving and ergonomically designed gardening tool useful for transplanting seedlings and other gardening tasks. A creased metal blade has a faceted cutting edge with straight sides. A cylindrical handle supports the flat end of the blade with the fasteners.

U.S. Pat. No. 5,365,632 illustrates a clean-up pan that has an acute trough-shaped bottom wall defining a side opening pouring spout for discharging material from the pan into a receiving receptacle. The bottom wall has a relatively large capacity, and its configuration reduces the likelihood of spillage when the pan contents are poured from the pan into a receiving receptacle.

U.S. Pat. No. 4,631,774 shows an improvement in a dust collecting apparatus of the type having a dust receiving pan with a flat bottom wall, a straight lip at a leading portion of the bottom wall and a dust containing wall extending upwardly from the bottom wall. According to the invention, spaced, side wall portions of the dust containing wall have support edges substantially perpendicular to the bottom wall and residing in a single plane with the lip. The side wall portions have free upper edges at right angles to the support edges.

U.S. Pat. No. 4,245,411 describes an improved scoop type snow scraper/lifter that has a length to reach at substantially a 45 degree angle from the ground to the user's hip level, a symmetrical trapezoidal shape with faired-in handgrips at the transverse upper end spaced apart at nominal human hip spacing, these critical dimensions coact with the structure to permit substantially strain-free pushing and scooping of snow by leaning or bumping urging of the unit with the hips which are cushioned by the hands on the handgrips and substantially strain-free lifting of snow scooped, by pivoting the unit on one knee and pressing down on the handgrips to raise the snow and pivot it aside; tapered construction and a spaced pair of skids make the unit less likely to cause injury if broken and quieter in operation.

U.S. Pat. No. 3,026,138 describes a hand scoop comprising: a longitudinally tapered trough open at both ends, said trough including substantially flat bottom and upstanding, forwardly convergent side walls, and inverted U-shaped carrying handle affixed to said side walls on the rear end portion of the trough, a substantially U-shaped plate mounted transversely on the forward portion of the trough and having its end portions affixed to the side walls, a gate hingedly mounted for vertical swinging movement on said plate and operable in the trough within the confines thereof and in rearwardly spaced relation to the forward end thereof for controlling the discharge of material therefrom, said gate, when open, and said plate defining, in conjunction with the trough, a tubular discharge spout for the material, and a substantially U-shaped handle fixed on the hinged end portion of the gate for operating same and for carrying the forward end of the trough.

U.S. Pat. No. 2,864,117 describes a dust pan formed from one single sheet of material providing a flat, irregular, quadrilateral, bottom wall having straight converging front and rear side edges which approach each other to form one wall and discharge end of a pouring spout, said sheet material extending upwardly from said bottom between the divergent ends thereof to provide one side wall of the pan, said sheet material also extending upwardly along the rear edge to form a second side wall, said second side wall abutting said one side wall and having fowardly extending wall portion overlying a substantial portion of said bottom wall between said discharge end of said pouring spout and said one side wall of the pan, said forwardly extending wall portion also overlying said one side wall and having a down-turned section secured to the outer side of said one side wall adjacent the abutting ends of said side walls, a handle projecting upwardly and rearwardly from said abutting ends of said side walls and having divergent strap portions embracing each of said walls and rigidly connecting thereto.

U.S. Pat. No. 741,195 describes an article of manufacture, a grain-scoop comprising a body portion formed with a bottom, parallel side walls extending upwardly from said section, each of said side walls being provided with an inwardly and downwardly directed lip or terminal, adapted to hold the contents against lateral movement, a scooping edge at each end of the body portion, and suitable handles located at a proper point on the scoop, whereby the scoop may be swung to the right or left to gather and/or empty grain into a receptacle without reversing the ends of the scoop.

U.S. Pat. No. 636,735 illustrates a scoop made of a single sheet of metal with a flat bottom and with a back and sides connected by triangular segments.

U.S. Pat. No. 633,787 describes a dustpan with an otherwise normal configuration, but includes an open side for dumping, opposite a normal sidewall.

U.S. Pat. No. 280,990 shows another dustpan that includes two adjacent front scoops at right angles to one another.

U.S. Pat. No. 256,150 illustrates a grain scoop having a back handle and a front handle wherein the back handle is an extended wire rim for the scoop walls, and the front scoop is pivoted.

U.S. Pat. No. 63,139 shows a grain shovel having a back handle and a front handle wherein the back handle is attached to the back wall and the front handle is pivotally connected to the front edges of the sidewalls.

U.S. Pat. Design No. 392,522 shows a snow shovel with a sloped top on a curved base.

U.S. Pat. Design No. 322,543 shows a snow scoop with a flat bottom, a pitched front and side walls with cut-in handles.

Notwithstanding the prior art, the present invention is neither taught nor rendered obvious thereby.

SUMMARY OF THE INVENTION

The present invention relates to a scoop for use on non-horizontal work surfaces, such as land slopes, roofs and the like. The scoop includes a first base panel and a second base panel, each of the first and second base panels having a front, a back and two sides. The first base panel and the second base panel are connected to one another along a side of each to establish a seam wherein a first angle measured perpendicular to that seam and is formed by the first and second panels, is about 120 degrees to about 170 degrees.

The present invention scoop also includes a first wall panel and a second wall panel, the first wall panel being connected to the first base panel on a side opposite the seam and at an angle, referred to herein as the second angle, being about 120 degrees to about 170 degrees. The second wall panel is connected to the second base panel on a side opposite the seam and at an angle, referred to herein as a third angle, of about 120 degrees to about 170 degrees.

There is also a back panel, which is connected to the backs of the first and second base panels.

In some preferred embodiments, the scoop first base panel and second base panel are rectangular, with lengths that are greater than their widths, the lengths being defined as lengths running along the seam.

An optional but preferred feature of the present invention is at least one handle connected to the scoop. Thus, in some embodiments, the present invention scoop further includes a handle located on at least one of the back panel, the first wall panel and the second wall panel. The handle is desirably located on the back panel. However, in other embodiments, the handle is located on at least one of the first wall panel and the second wall panel, for example, a single handle might be connected to one wall panel, or two handles may be utilized with one on a wall panel, and one on the back of the device.

In some preferred embodiments, the scoop first angle is between about 150 degrees and 170 degrees. In other embodiments, the scoop second angle and third angle are each about 120 degrees to about 150 degrees. In yet other preferred embodiments, the scoop first angle is about 150 degrees and 170 degrees and both the second angle and the third angle are each about 120 degrees to about 150 degrees.

The present invention scoop first base panel, second base panel, first wall panel, second wall panel and back are all formed from a single integrated piece The scoop first wall panel and second wall panel may each be connected to the back panel. The scoop may be a metal scoop, a plastic scoop or other materials, or a combination thereof. Aluminum and plastic are choice materials.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
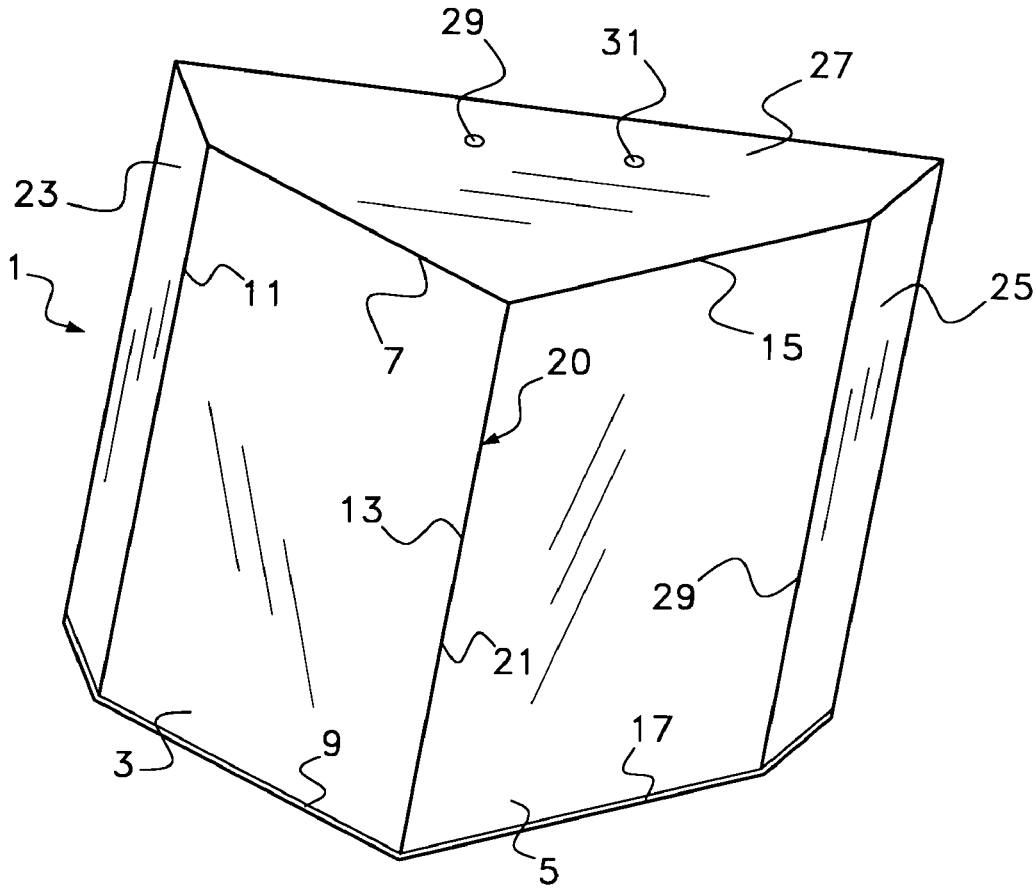
FIG. 1 illustrates an oblique top view of a preferred embodiment of a present invention scoop.

FIG. 1 illustrates an oblique top view of a preferred embodiment present invention scoop 1, having a first base panel 3 and a second base panel 5. Each of the first and second base panels 3 and 5 have a front, a back and two sides. First base panel 3 has a front 9, a back 7, and sides 11 and 13. Second base panel 5 has a front 17, a back 15, and sides 19 and 21. The first base panel 3 and the second base panel 5 are connected to one another along a sides 13 and 21, respectively, to establish a seam 20, wherein a first angle measured perpendicular to seam 20 is formed by the first and second base panels at about 120 degrees to about 170 degrees. This is further illustrated in conjunction with FIG. 4, below.

Further, in FIG. 1, there is a back panel 27 of scoop 1 that is pentagonal and is connected to base panels 3 and 7, as shown. It is also connected to wall panels 23 and 25. It should be noted that scoop 1 has a number of different positions in which it may be used to sweep or push items into or remove items from. For example, base panel 3 may be placed flat on a surface and items could be loaded or offloaded over front 9. Alternatively, base panel 5 may be placed flat on a surface and items could be loaded or offloaded over front 17. Alternatively, either side panel 23 or side panel 25 could be placed flat on a surface and used much like the front of a dust pan. The scoop 1 is particularly useful on sloped surfaces, such as roofs, wherein either side panel 23 or side panel 25 could be placed flat on a sloped roof and used much like the front of a dust pan or a scoop to receive old. Ripped off shingles or other roofing waste, or could be used to carry and deliver new roofing materials. It could advantageously be similarly used for terrace gardening or other work on sloping land.

Figure 2:
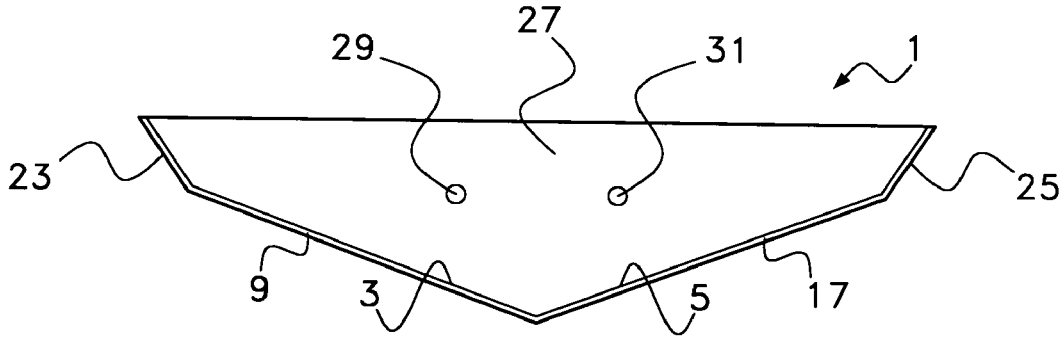
FIG. 2 shows a front view thereof.

FIG. 2 shows a front view of scoop 1 wherein identical elements are identically numbered.

Figure 3:
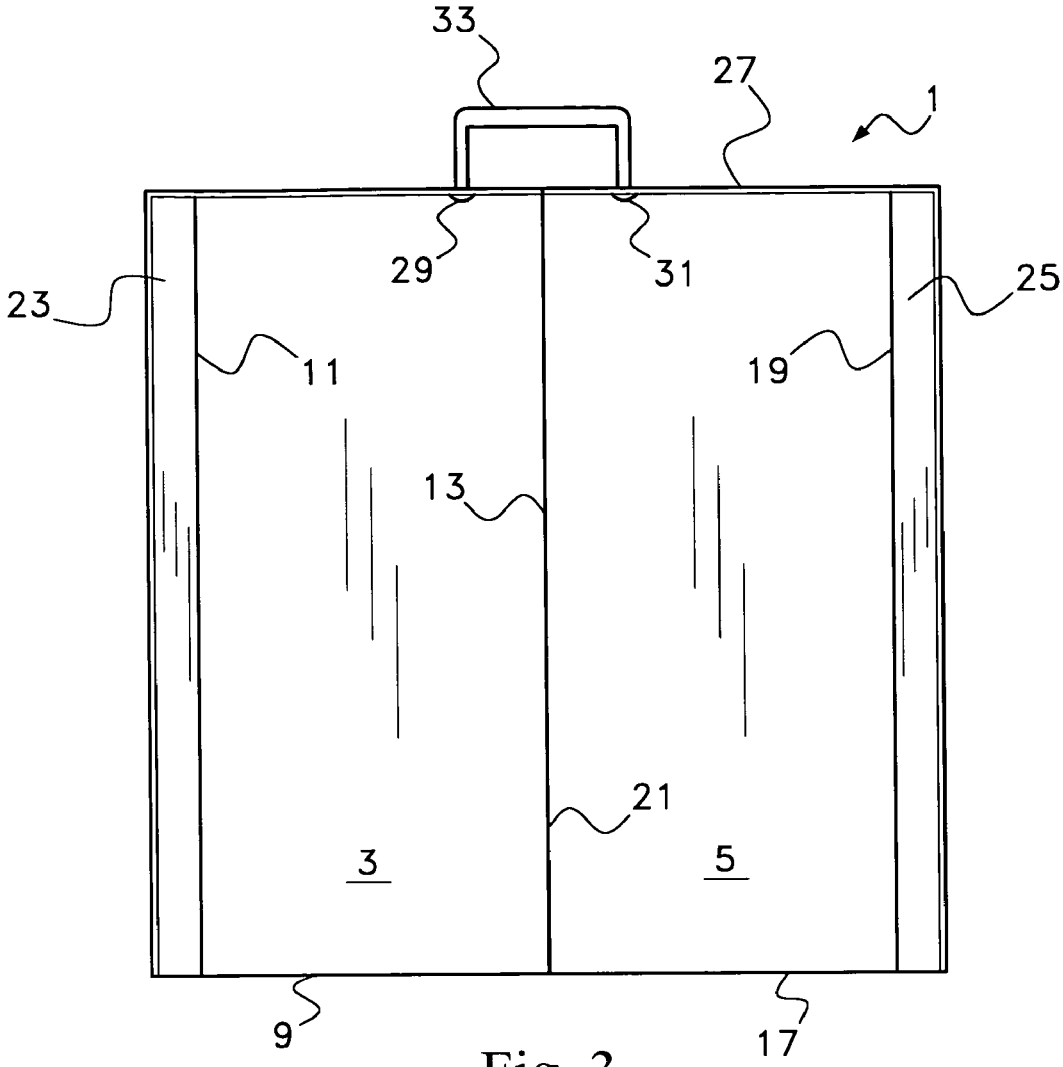
FIG. 3 shows a top view thereof.

Referring to all of FIGS. 1, 2 and 3 (FIG. 3 shows a top view of scoop 1), handle rivets 29 and 31 are shown centered on back panel 27, and FIG. 3 reveals handle 33 on the obverse thereof. Alternatively, or in addition, the handle could be located on a side panel.

Figure 4:
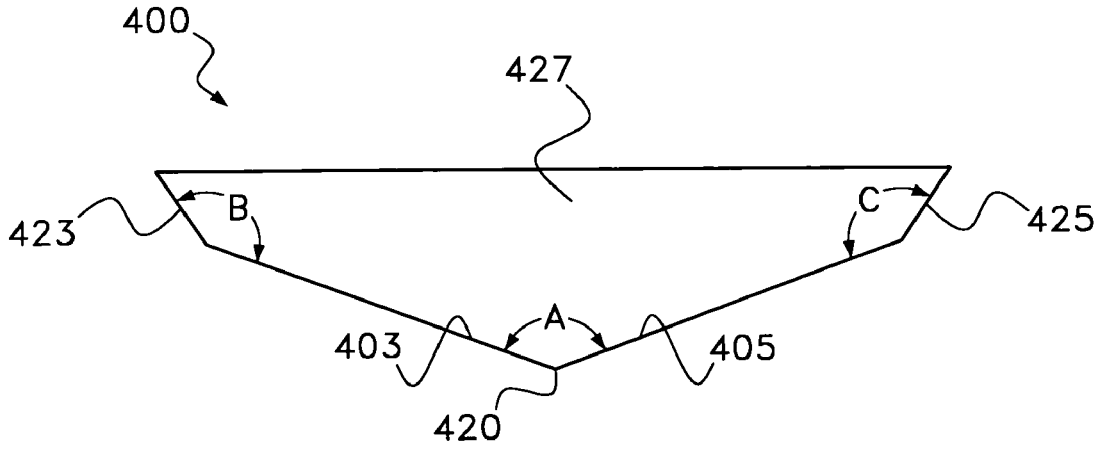
FIG. 4 shows a front schematic conceptual view of a present invention scoop; and, FIG. 5 shows a present invention scoop in use on a roof for the removal of roofing materials.

FIG. 4 shows a front schematic conceptual view of a present invention scoop 400. It has a left base panel 403 and a right base panel 405 that, together form an angle A at seam 420. Angle A is measured perpendicular to seam 420 and is formed by the first and second base panels at about 120 degrees to about 170 degrees, and in some preferred embodiments, the scoop first angle is between about 150 degrees and 170 degrees. The first (left) base panel 403 and the second (right) base panel 405 each have side wall panels 423 and 425 to which they are respectively connected, and with which they respectively form angles B and C. These are also referred to herein as scoop second angles and scoop third angles. These scoop second and third angles B and C are about 120 degrees to about 170 degrees. In some preferred embodiments, the scoop second angle and third angle are each about 120 degrees to about 150 degrees. Further, although the drawings herein show symmetry as to sizes, shapes and angles of the elements of the present invention scoop, it is within the present invention scope to include asymmetric variations and alternative shapes. The ranges of angles should be maintained, but the various panels do not need to be rectangular and could be any shape that would maintain the functionality of the device. It is the combinations of angles A, B, and C that enable the present invention to have such diverse applications and uses.

Figure 5:
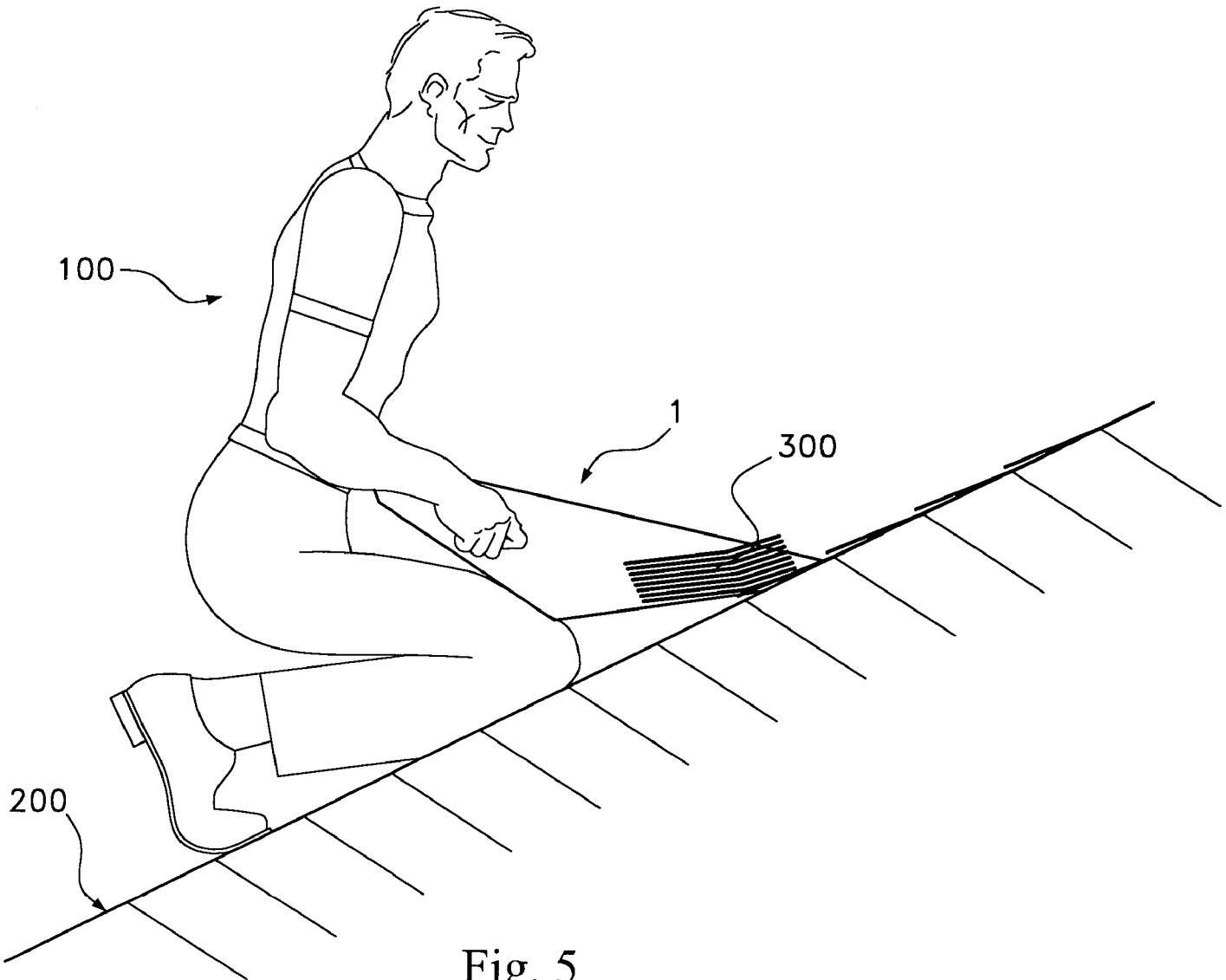

FIG. 5 shows a present invention scoop in use on a roof for the removal of roofing materials. Here, person 100 is on a sloped surface, namely, a roof, but this could as well be a sloped ground area, a ramp, steps, a mound of material like sand, aggregate, or other supply or waste, and still be within the exceptionally apropos applications of the present invention scoops. Person 100 is kneeling ad has placed present invention scoop 1 at an angle wherein one of the wall panels is positioned flatly against roof 200, as shown. Person 100 has pushed old roofing shingles down into scoop 1 for subsequent removal from the roof 200. Handle 33 (FIG. 3) is used to stronghold the scoop 1 and a second hand holds it underneath to carry it to the roof edge, and to swing the scoop 1 to shoot the debris into a dumpster, truck or the like. It may similarly be carried to bring new supplies up the roof, as a user may desire. On landscaping, it can be used to bring potted plants, planting tools and other materials to slopes and can be used to bring down removed debris, cuttings, tools, etc. from the slopes. Other diverse uses should now be apparent.

Obviously, numerous modifications and variations of the present invention are possible in light of the above teachings. It is therefore understood that within the scope of the appended claims, the invention may be practiced otherwise than as specifically described herein.

What is claimed is:

1. A scoop for use on non-horizontal work surfaces, which consists of:

(a.) a first base panel and a second base panel, each of said first and second base panels having a front, a back and two sides, said first base panel and said second base panel being connected to one another along a side of each to establish a seam wherein a first angle measured perpendicular to said seam and formed by said first and second panels, is about 120 degrees to about 170 degrees;

(b.) a first wall panel and a second wall panel, said first wall panel being connected to said first base panel on a side opposite said seam and at a second angle of about 120 degrees to about 170 degrees, said second wall panel being connected to said second base panel on a side opposite said seam and at a third angle of about 120 degrees to about 170 degrees;

(c.) a back panel, said back panel being connected to the backs of said first and second base panels; and (d.) a handle located on said back panel;

wherein said first base panel, said second base panel, said first wall panel, said second wall panel, and said back panel form a scoop structure having an open front and an open top.

2. The scoop of claim 1 wherein said first base panel and said second base panel are rectangular with lengths that are greater than their widths, said lengths running along said seam.

3. The scoop of claim 1 wherein said first angle is between about 150 degrees and 170 degrees.

4. The scoop of claim 1 wherein said second angle and said third angle are each between about 120 degrees to about 150 degrees.

5. The scoop of claim 1 wherein said first angle is between about 150 degrees and 170 degrees and said second angle and said third angle are each between about 120 degrees to about 150 degrees.

6. The scoop of claim 1 wherein said first base panel, said second base panel, said first wall panel and said second wall panel are all formed from a single integrated piece.

7. The scoop of claim 1 wherein said scoop is a metal scoop.

8. The scoop of claim 7 wherein said metal scoop is an aluminum scoop.

9. The scoop of claim 1 wherein said scoop is a plastic scoop.

10. The scoop of claim 1 wherein said first wall panel and said second wall panel are each connected to said back panel.

11. The scoop of claim 10 wherein said single piece of material is a metal material.

12. The scoop of claim 11 wherein said scoop includes a handle that is located on an outside surface of said back panel.

13. The scoop of claim 10 wherein said single piece of material is a plastic material.

14. The scoop of claim 1 wherein said first base panel, said second base panel, said first wall panel, said second wall panel and said back panel are made of a single piece of material.

15. The scoop of claim 14 wherein said scoop is made of aluminum.

* * * * *